US007162746B2

(12) United States Patent
Reynolds

(10) Patent No.: US 7,162,746 B2
(45) Date of Patent: Jan. 16, 2007

(54) BODY FORM-FITTING RAINWEAR

(76) Inventor: Eric M. Reynolds, 838 N. St., Boulder, CO (US) 80304

( * ) Notice: Subject to any disclaimer, the term of this patent is extended or adjusted under 35 U.S.C. 154(b) by 0 days.

(21) Appl. No.: 10/316,343

(22) Filed: Dec. 11, 2002

(65) Prior Publication Data

US 2003/0106130 A1 Jun. 12, 2003

Related U.S. Application Data

(60) Provisional application No. 60/340,686, filed on Dec. 12, 2001.

(51) Int. Cl.
*A41D 31/02* (2006.01)
*A41D 3/04* (2006.01)

(52) U.S. Cl. ..... 2/87; 2/82; 2/69; 2/200.1; 2/904; 2/400

(58) Field of Classification Search ..... 2/87, 2/85, 82, 93, 106, 108, 113, 115, 243.1, 272, 2/455–457, 51, 69, 69.5, 79, 78.1, 904, 901, 2/97, 114, 171, 202, 84, 200.1, 167, 400, 2/402, 403, 406, 227, 238, 239, 275, DIG. 1, 2/DIG. 5; 428/304.4, 308.4, 311.11, 315.5, 428/315.9, 913; 442/77, 80, 85, 86, 88, 82
See application file for complete search history.

(56) References Cited

U.S. PATENT DOCUMENTS 34,890 A 4/1862 Knight
3,870,593 A 3/1975 Elton et al.
4,430,759 A 2/1984 Jackrel
4,443,511 A 4/1984 Worden et al.
4,454,191 A * 6/1984 Von Blucher et al. ... 428/314.2
4,469,744 A 9/1984 Grot et al.
4,507,880 A 4/1985 Ohashi
4,518,650 A 5/1985 Grot et al.
4,545,841 A 10/1985 Jackrel
4,550,446 A 11/1985 Herman
4,599,810 A 7/1986 Sacre
4,613,544 A 9/1986 Burleigh
4,819,345 A 4/1989 Mulcahy et al.
4,829,683 A 5/1989 Chikamori
4,833,026 A 5/1989 Kausch
4,856,207 A 8/1989 Datson (Continued)

OTHER PUBLICATIONS

"W.L. Gore & Associates Unveils Next Generation of Windstopper N2S TM Fabric Collection for Lightweight and Midweight Garments", Gore-Tex and Windstoper Fabrics 2001 Press Release, Sep. 10, 2001, p. 1.

(Continued)

*Primary Examiner*—A. Vanatta
(74) *Attorney, Agent, or Firm*—Lathrop & Gage LC

(57) ABSTRACT

A non-terminated, multi-aperture body form-fitting rainwear is provided. In the rainwear, a first waterproof moisture vapor permeable hydrophobic layer couples to a first fabric layer. The first fabric layer faces the body and couples to a first side of the first waterproof moisture vapor permeable hydrophobic layer. The first waterproof moisture vapor permeable hydrophobic layer and first fabric layer are formable about a human body and are constructed and arranged with multiple apertures to accommodate, without termination, two or more human appendages. The rainwear may for example form a shirt, pant, underwear, long underwear and a one-piece body suit.

45 Claims, 6 Drawing Sheets

U.S. PATENT DOCUMENTS 4,899,465 A 2/1990 Bleimhofer et al.
4,918,981 A 4/1990 Gore
4,932,078 A 6/1990 Jones et al.
5,022,109 A 6/1991 Pekar
5,026,591 A 6/1991 Henn et al.
5,158,636 A 10/1992 Groitzsch et al.
5,236,769 A * 8/1993 Paire ..... 428/196
5,244,716 A * 9/1993 Thornton et al. ..... 428/198
5,260,360 A * 11/1993 Mrozinski et al. ..... 524/95
5,289,644 A 3/1994 Driskill et al.
5,364,678 A * 11/1994 Lumb et al. ..... 428/96
5,402,540 A 4/1995 Williams
5,409,761 A 4/1995 Langley
5,426,869 A 6/1995 Gore et al.
5,480,455 A * 1/1996 Norvell ..... 2/904
5,505,011 A 4/1996 Bleimhofer
5,526,532 A * 6/1996 Willard ..... 2/69
5,526,584 A 6/1996 Bleimhofer et al.
5,596,770 A 1/1997 Kunesh
5,628,127 A 5/1997 Notzold
5,640,718 A * 6/1997 Aldridge ..... 2/81
5,642,573 A 7/1997 Brown
5,685,091 A 11/1997 Yalamanchili
5,689,903 A 11/1997 Aumann
5,690,949 A * 11/1997 Weimer et al. ..... 428/315.5
5,732,413 A 3/1998 Williams
5,732,480 A 3/1998 Notzold
5,804,011 A 9/1998 Dutta et al.
5,832,539 A 11/1998 Williams
5,925,441 A 7/1999 Blauer et al.
5,933,984 A 8/1999 Carlson et al.
5,964,047 A 10/1999 Covatch
5,981,019 A 11/1999 Goodwin et al.
5,992,054 A 11/1999 Rauch
6,018,819 A * 2/2000 King et al. ..... 2/69
6,040,251 A * 3/2000 Caldwell ..... 2/114
6,074,738 A 6/2000 Von Fragstein et al.
6,092,305 A 7/2000 Troy et al.
6,235,662 B1 * 5/2001 Zehnder ..... 428/316.6
6,336,221 B1 * 1/2002 Blauer et al. ..... 2/87

OTHER PUBLICATIONS

"Transition Fleece One layer does the work of three", http://www.mountainhardwear.com/clothes/transition.html, Sep. 10, 2001, p. 1.
"Vapor Barrier: Benefits of Vapor Barrier", http://www.warmlite.com/vb.htm, Sep. 10, 2001, pp. 1-3.
"Vapor Barrier Clothing: Stephenson No Sweat Shirt", http://www.warmlite.com/vb_shirt.htm, Sep. 10, 2001, pp. 1-2.
"Warmlite Triple Bags", http://www.warmlite.com/Bags.htm, Sep. 10, 2001, pp. 1-5.
"Ponchos and Rain Jackets: Related Subject:Rain Gear", http://www.warmlite.com/ponchos.htm, Sep. 10, 2001, p. 1.
"Better Than The Skin You're In", advertisement, 3 pages.

* cited by examiner

BODY FORM-FITTING RAINWEAR

RELATED APPLICATIONS

This application claims priority to U.S. Provisional Application No. 60/340,686, filed Dec. 12, 2001 and incorporated herein by reference.

BACKGROUND OF THE INVENTION

The prior art is familiar with various forms of rainwear. However, much of this rainwear is uncomfortable because the rainwear does not efficiently transmit water vapor away from the body. Other prior art rainwear can be bulky and uncomfortable to wear; that is, generally the outer most layer of a multi-layer system provides the rain protection.

There is a need for improvements to rainwear. It is, accordingly, one feature hereinbelow to provide a new type of rainwear that fits snugly to the body to provide both comfort and rain protection. Other features are apparent within the description that follows.

SUMMARY OF THE INVENTION

As used herein, moisture vapor transmission rate (MVTR) means the amount of moisture vapor transmission through a fabric as measured by the JIS-1099-B2 method.

As used herein, waterproof penetration or resistance in "psi" means that the material withstands water penetration to at least the stated pounds per square inch as measured by the Mullen test method.

As used herein, "hydrophilic" means a material that absorbs water.

As used herein, "hydrophobic" means that a material that will not absorb water.

As used herein, "substantially hydrophobic" means that a material will gain no more than 10% in weight in water when fully saturated by water.

As used herein, expanded polytetrafluoroethylene with a hydrophobic oleophobic treatment may be manufactured according to GORE-TEX® XCR® 3-LAYER Fabric and BHA eVENT™ Fabric technology known in the art.

As used herein, "form fit" means a material that fits close to body but does not restrict freedom of movement. Preferably, a "form fit" material also allows other garments to fit over it comfortably.

As used herein, "skin tight" means a clothing material that substantially contacts human skin, throughout the full internal area of the material, when worn by a user.

As used herein, "adhesive dots" are glue which couple two layers of material together.

As used herein, "termination" implies a clothing item with only one aperture, like a glove; once a hand enters terminated clothing, like a glove, then that hand may only leave the clothing, generally, back through the same aperture. "Non-terminated" implies clothing such as pants, long underwear, underwear, one-piece body suits, and shirts, where several apertures permit use of the clothing around the human appendages and without termination.

In one aspect, non-terminated, multi-aperture body form-fitting rainwear is provided. In the rainwear, a first waterproof moisture vapor permeable hydrophobic layer couples to a first fabric layer. The first fabric layer faces the body and couples to a first side of the first waterproof moisture vapor permeable hydrophobic layer. The first waterproof moisture vapor permeable hydrophobic layer and first fabric layer are formable about a human body and are constructed and arranged with multiple apertures to accommodate, without termination, two or more human appendages. This aspect may for example form a shirt, pant, underwear, long underwear and a one-piece body suit.

In accord with one aspect, the inner hydrophobic fabric layer pulls sweat off the body by wicking action to spread over a large surface area in order to facilitate a rapid transfer of moisture through the layers. This function may be accomplished by surface treatments with the fiber providing capillary action. Polyester is one such hydrophobic material and an ideal synthetic.

In one aspect, the waterproof hydrophobic layer resists water penetration to at least 2 psi, and preferably at least 10 psi.

In another aspect, the layer adjacent human skin is a "bicomponent" knit, so that sweat is "wicked" off the body; that moisture is then pulled to the second side of the knit where it spreads over a larger surface area adjacent the waterproof layer. The spreading occurs because (a) there is a stronger wicking finish on the outer knit side (so there is a differential wicking factor between the two yarns), and/or (b) the first part of the bicomponent is comprised of yarns with a certain number of filaments and a second part of the bicomponent is comprised of yarns with a greater number of filaments which have a much higher surface area (hence a stronger capillary action).

In one preferred aspect, the body form-fitting rainwear includes two key features as compared to the prior art:

1. The rain barrier is close to the body and underneath other layers that provide insulation, wind, and water repellent functions.
2. The rainwear is not based upon a "wet system" technology, known in the art. Wet systems utilized a hydrophilic component in the waterproof layer to aid in the movement of water through the material. By having a hydrophilic layer in the system, liquid water is retained in the material. This water is undesirable in close proximity to the body as liquid water conducts heat away from the body at a very high rate, increasing heat loss.

However, hydrophilic layers may also be used. In one aspect, non-terminated, multi-aperture body form-fitting rainwear is provided. In the rainwear, a first waterproof moisture vapor permeable hydrophilic layer couples to a first fabric layer. The first fabric layer faces the body and couples to a first side of the first waterproof moisture vapor permeable hydrophilic layer. The first waterproof moisture vapor permeable hydrophilic layer and first fabric layer are formable about a human body and are constructed and arranged with multiple apertures to accommodate, without termination, two or more human appendages. This aspect may for example form a shirt, pant, underwear, long underwear and a one-piece body suit.

In accord with one aspect, the inner hydrophilic fabric layer pulls sweat off the body by wicking action to spread over a large surface area in order to facilitate a rapid transfer of moisture through the layers. This function may be accomplished by surface treatments with the fiber providing capillary action.

In another aspect, the layer adjacent human skin is a "bicomponent" knit, so that sweat is "wicked" off the body; that moisture is then pulled to the second side of the knit where it spreads over a larger surface area adjacent the waterproof layer. The spreading occurs because (a) there is a stronger wicking finish on the outer knit side (so there is a differential wicking factor between the two yarns), and/or (b) the first part of the bicomponent is comprised of yarns with a certain number of filaments and a second part of the bicomponent is comprised of yarns with a greater number of filaments which have a much higher surface area (hence a stronger capillary action).

In another aspect, the rainwear includes an outer fabric layer coupled to a second side of the waterproof hydrophilic layer for protecting the first waterproof hydrophilic layer and the first fabric layer and without interference with the apertures. The outer fabric layer is generally selected from the group consisting of woven, knit, or non-woven material(s). The outer fabric is ideally non-wicking but it should have a strongly water repellant finish an the hydrophobic layer. It may for example be polyester or nylon treated with water repellant chemicals (such as fluorocarbon or silicones) so that penetrating rain generally stays off of the membrane layer (i.e., the hydrophilic layer).

The rainwear may be extended, in another aspect, by two additional layers. A second waterproof moisture vapor permeable hydrophobic (or hydrophilic) layer has a first side coupled to a second side of the first waterproof hydrophilic layer. A second fabric layer couples to a second side of the second waterproof moisture vapor permeable hydrophobic (or hydrophilic) layer. The first and second waterproof moisture vapor permeable hydrophobic (or hydrophilic) layers and the first and second fabric layers are formable about a human body and are constructed and arranged with the multiple apertures to accommodate, without termination, the two or more human appendages.

In still another aspect, the coupling of these four layers includes utilizing new and novel waterproof seams, as described herein.

The rainwear thus provides several advantages. Since the waterproof layer is next to the body, it is protected from the wear and tear of use. There is also less chance of the waterproof layer losing its protection because it most commonly will function as an "internal" layer, which is more easily protected from the abrasions, punctures, rips, and tears experienced by outer clothing. Moreover, the waterproof/breathable barrier is placed in close proximity to the heat engine of the body where the driving forces that power the transmission of water vapor are most powerful. Accordingly, once the water vapor has been pushed through the close-to-body waterproof layer, that vapor will not go back into contact with the body and contribute to conductive or evaporative heat loss. Additionally, a garment construction in a body form-fitting, or skin tight manner uses less fabric and is hence less expensive to produce. As well, a rain garment of this type will allow greater freedom of movement than traditional rainwear used as the outer layer in a clothing layering system. In another advantage, an inner garment rainwear as described herein is less expensive, as compared to the prior art, since it does not generally include pockets, flaps or decorative styling features.

BRIEF DESCRIPTION OF THE DRAWINGS

A more complete understanding of the invention may be obtained by reference to the drawings, in which.

DETAILED DESCRIPTION OF THE DRAWINGS

Figure 1A:
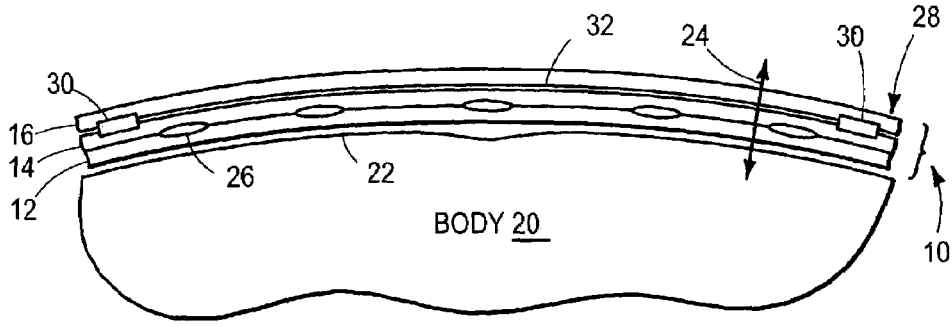
FIG. 1A illustrates one two-layer rainwear laminate and optionally coupled with an outer layer.

FIG. 1A shows one rainwear 10 that protects a human body 20 from rain. Rainwear 10 is shown with three-layers; layer 12 is an inner fabric layer adjacent to the skin of body 20; layer 14 is a waterproof moisture vapor permeable hydrophobic layer; and layer 16 is optional and represents an outer fabric layer. Rainwear 10 is preferably "form fit" to the body. That is, if rainwear 10 is "skin tight," the spacing 22 between body 20 and rainwear 10 is essentially zero millimeters. If rainwear 10 is loosely fitted to body 20, then spacing 22 may be up to about twenty-five millimeters. Those skilled in the art appreciate that gap 22 is illustrative and that gap 22 may vary throughout in interfacing between rainwear 10 and body 20; specifically, rainwear 10 may also contact body 20 in some locations even though a gap exists, on average, for the whole interface between body 20 and rainwear 10. When skin tight, rainwear 10 essentially eliminates gaps 22, 32.

Generally, rainwear 10 has a MVTR of 5,000 or more, to provide comfort. Layer 14 may for example be made from expanded polytetrafluoroethylene with a hydrophobic air permeable oleophobic treatment, or from expanded polytetrafluoroethylene with a hydrophilic oleophobic treatment. Layer 14 may also be a polyurethane, polyolofin, or a waterproof polymer layer. Layer 14 absorbs less than 30%, and preferably less than 10% in water weight when fully saturated by water. In one embodiment, layer 14 absorbs less than 1%, and preferably less than 0.001% in water weight when fully saturated by water. Layer 12 maybe a knitted (e.g., a plaited knit), woven or non-woven fabric; preferably layer 12 is a bicomponent knit. Layer 16 may for example be a nylon, polyester, acrylic, polypropylenc polyotefin or synthetic fiber material.

Along direction 24, layer 14 has a thickness generally less than 2 mm. Layer 12 may couple to layer 14 by glue or adhesive dots 26, as shown. Outer layer 16 is preferably sewn to layer 14 at the perimeter 28 of rainwear 10, such as shown by sewing material 30. Only a small air gap 32 generally exists between layer 14 and layer 16; gap 32 for example is generally less than twenty millimeters and is preferably less than two millimeters; layer 16 may also be in direct contact with layer 14. Those skilled in the art should again appreciate that gap 32 is illustrative and that gap 32 may vary throughout in interfacing between layer 14 and layer 16; specifically, outer layer 16 may also contact layer 14 in some locations even though a gap 32 exists, on average, for the whole interface between layer 14 and layer 16. Outer layer 16 may also be in designed for direct contact with layer 14, thereby eliminating gap 32.

It should be obvious to those skilled in the art that laminate rainwear 10 "surrounds" the body as "near-to-body" clothing and that FIG. 1A is simplified for illustrative purposes; moreover, elements of FIG. 1A are not to scale, also for illustrative purposes.

Figure 1B:
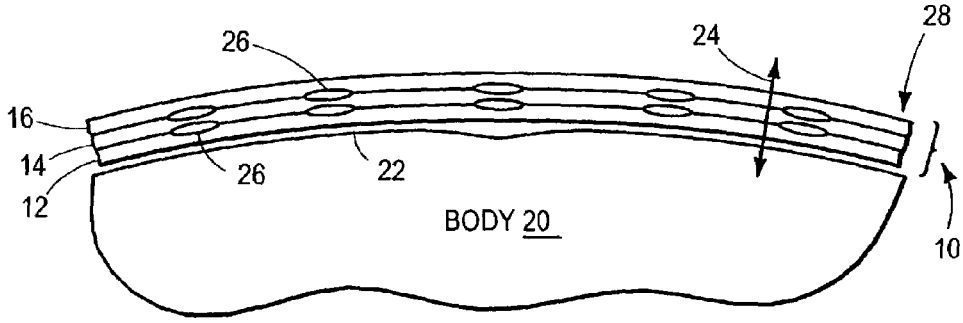
FIG. 1B illustrates one three-layer rainwear laminate.

In one embodiment, and as shown in FIG. 1B, outer layer 16 also couples with layer 14 with a plurality of glue or adhesive dots 26 similar to coupling between layers 12 and 14. Such rainwear may be called a "three-layer laminate" herein, thereby eliminating gap 32.

In one embodiment, layer 14 of FIG. 1A or FIG. 1B is instead a waterproof moisture vapor permeable hydrophilic layer.

Figure 2A:
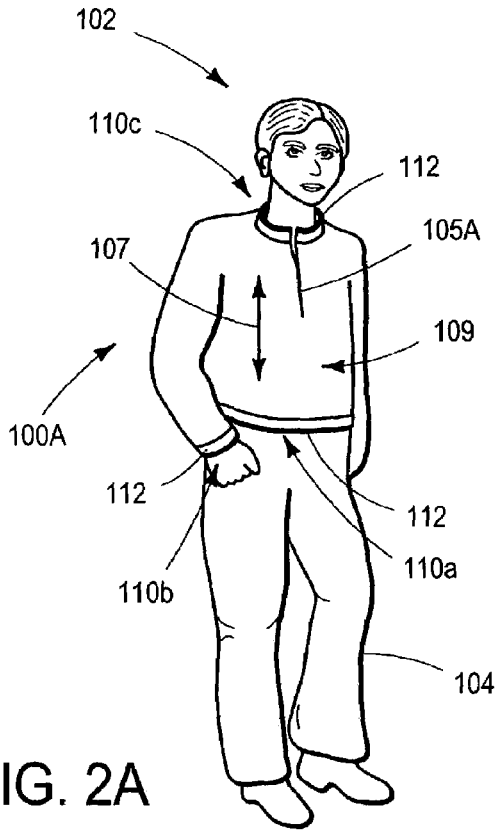
FIG. 2A illustrates one non-terminated, multi-apertured article of rainwear, as displayed on a person.

FIG. 2A shows one rainwear item 100A in the form of a long sleeve shirt, worn on a user 102. User 102 may wear item 100A on his body 104 such that item 100 interfaces with body 104 like rainwear 10 to body 20, FIG. 1A and FIG. 1B. Item 100A is "non-terminated" so that it forms around body 104 with apertures 110*a*, 110*b*, 110*c* accommodating, respectively, the torso, hands and head of body 104. Preferably, article 100A includes waterproof seam tape 112 at all or most of the seams joining the fabric pieces, in accord with the teachings herein. Rainwear 100A is shown with a zipper 105A that partially extends along a direction 107 of the torso 109 of user 102, in one embodiment.

Figure 2B:
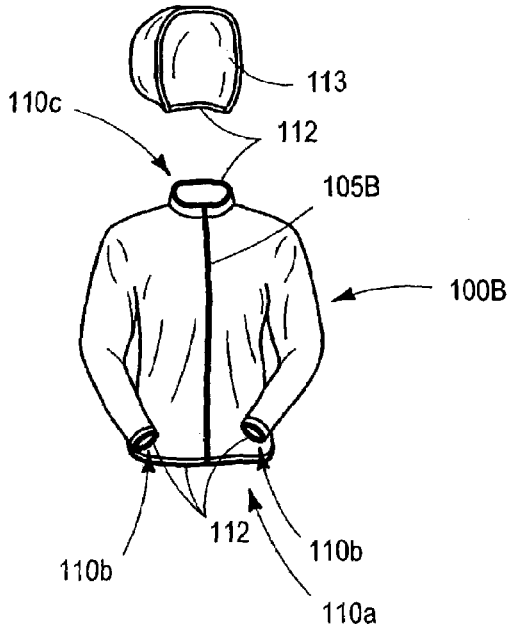
FIG. 2B illustrates another non-terminated, multi-apertured article of rainwear, and a terminated hood.

FIG. 2B shows another rainwear 100B similar to rainwear 100A. Rainwear 100B has a zipper 105B extending the full length of rainwear 100B, as shown. A hood 113 may be worn by user 102, for example. Hood 113 may be formed of the two-layer or three-layer laminates of FIG. 1A or 1B, and may further include seam tape 112. Hood 113 may permanently attach to rainwear 100B or optionally attach with snaps or zippers, as a matter of design choice.

The rainwear 100A and 100B of FIG. 2A and FIG. 2B, respectively, exemplify rainwear garments formable about a body 104 by the laminates described herein. In the following figures, as in FIG. 1A and FIG. 1B, such laminates are shown in cross-sectional views and in partial constructions about the human body for purposes of illustration. Those skilled in the art should appreciate that the laminates may be formed fully or partially about the body and into the desired garment as a matter of design choice.

Figure 3:
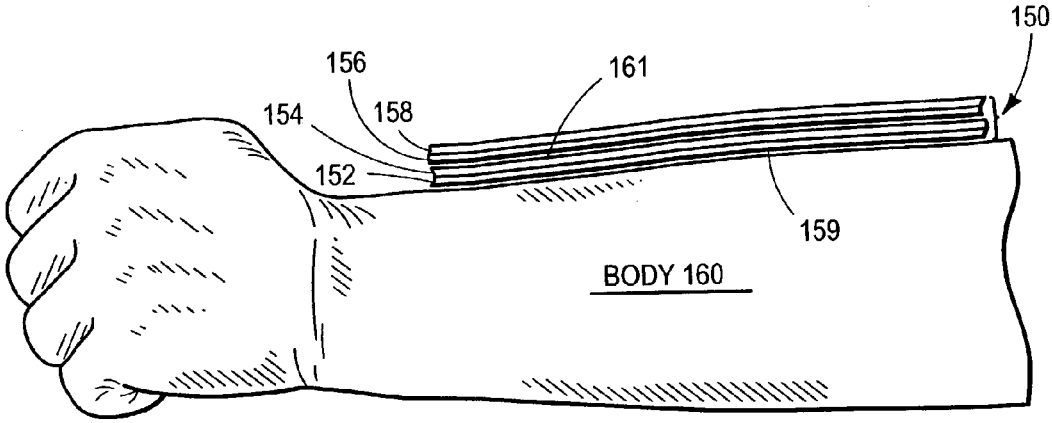
FIG. 3 illustrates a four-layer rainwear laminate.

FIG. 3 shows a four-layer rainwear laminate rainwear 150 for protecting a human body 160. Laminate rainwear 150 has layers 152, 154, 156, 158; layers 152 and 154 are the same as layers 12, 14, respectively, of FIG. 1; layers 156, 158 are also similar to layers 12, 14 of FIG. 1. Specifically, layer 156 is a second waterproof moisture vapor permeable hydrophobic layer and layer 158 is a second fabric layer coupled to layer 156. Layers 156, 158 may be coupled together as in layers 12, 14 of FIG. 1. Rainwear laminate 150 may also include an outer layer 16 (not shown in FIG. 3) as a matter of design choice. As above, a gap 159 may exist between body 160 and layer 152. A gap 161 may further exist between layers 154, 156, and between layer 158 and the outer layer (e.g., layer 16, if applied to layer 158). Laminate 152, 154 are for example coupled to laminate 156, 158 by a sewing material (e.g., sewing material 30, FIGS. 1A, 1B).

In one embodiment, one or both of layers 154, 156 of FIG. 3 is instead a waterproof moisture vapor permeable hydrophilic layer.

It should be apparent to those skilled in the art that rainwear 150 is shown in a cross-sectional view, for purposes of illustration, and that rainwear 150 forms about body 160 at the desired region to protect that body region from rain.

Figure 4:
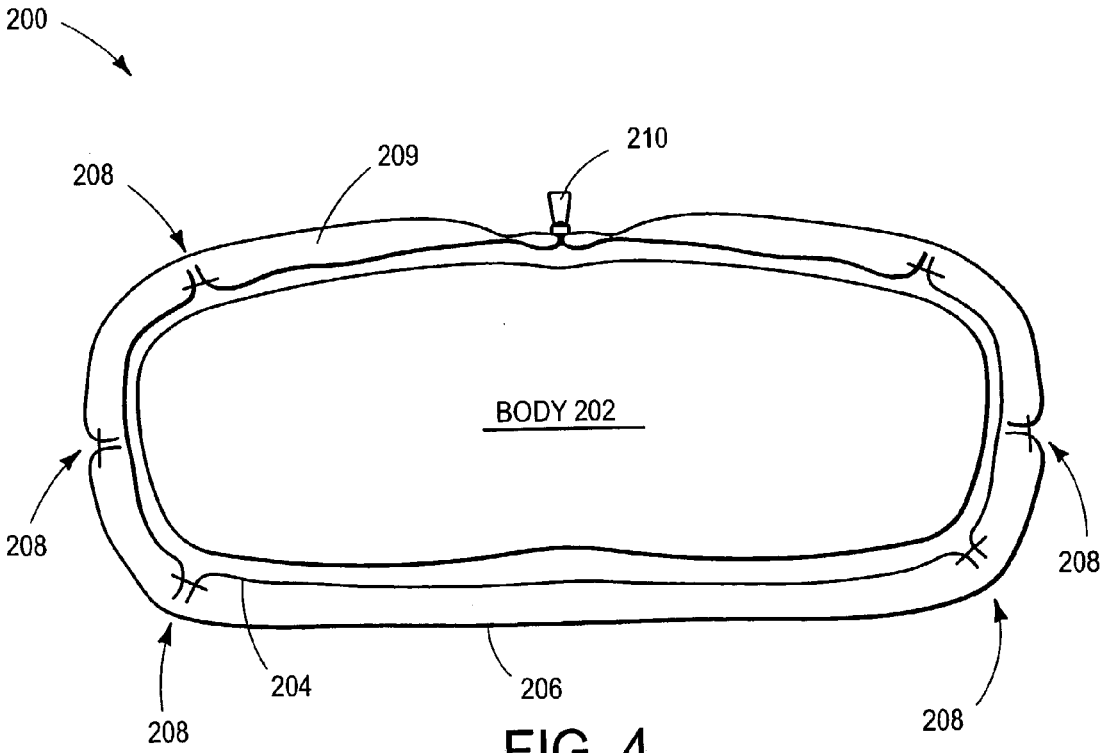
FIG. 4 shows one rainwear utilizing the four-layer laminate of FIG. 3.

FIG. 4 shows another rainwear 200 about a body 202. Rainwear 200 is made from layers 152, 154 (shown as a single layer 204) and layers 156, 158 (shown as a single layer 206). Rainwear 200 has offset seams 208 between layers 204, 206, as shown, to prevent moisture from directly penetrating any one layer 206, 208. A zipper 210 may be used to combine layers 204, 206 as a useful garment, e.g., a pant or shirt, or long underwear. Rainwear 200 may allow construction of a waterproof garment without seam tape 112, FIGS. 2A, 2B, for example, and as a matter of design choice. It should be apparent that FIG. 4 shows a cross-sectional view of rainwear 200 to clearly illustrate layers 204, 206, and that zipper 210 operates perpendicular to the plane of paper illustrating layers 204, 206.

Figure 5A:
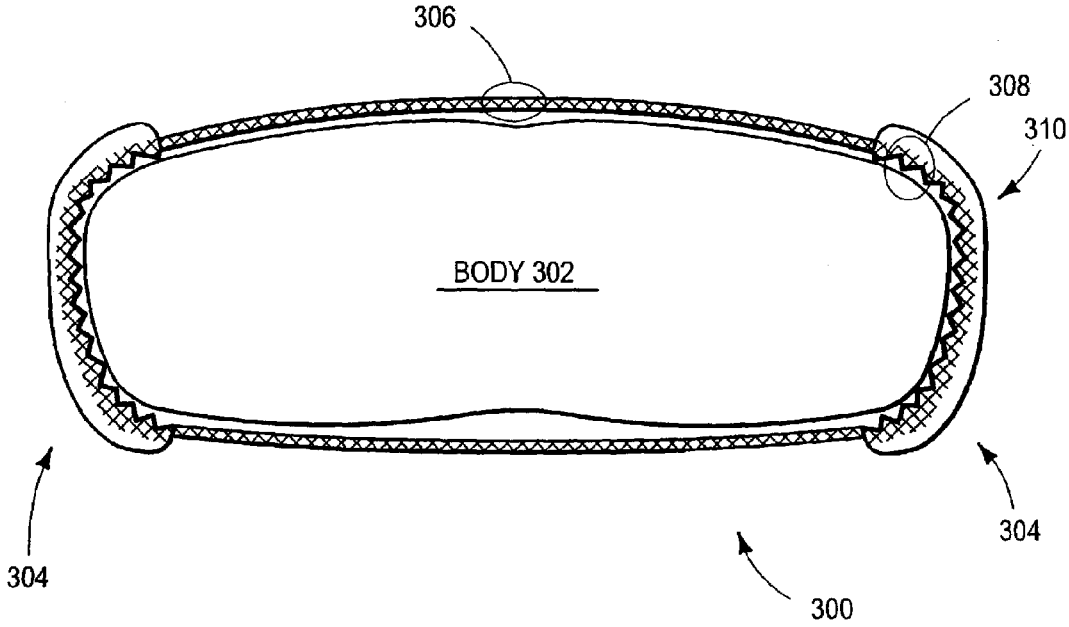
FIG. 5A shows one body form-fitting rainwear construction.

FIG. 5A shows another rainwear 300 (in cross-sectional view to illustrate layers of rainwear 300) about a body 302. Rainwear 300 has two side panels 304 that stretch about body 302 in creating a snug fit to body 302. Except for panels 304, rainwear 300 is made from a three-layer laminate 306, with little or no stretching capability; laminate 306 may include layers 12 and 14, FIG. 1, as the inner-most two layers (with layer 12 close to body 302), and an outer layer (e.g., layer 16). Panels 304, on the other hand, are made from either a two-layer or three-layer laminate 308 and an outer stretch knit 310. The inner-most two layers of laminate 308 are for example layers 12, 14, FIG. 1, again with layer 12 adjacent body 302. If a third layer exists in laminate 308, it is for example outer layer 16. Stretch material 310 may be either knit or woven material that pulls the entire rainwear 300 to body 302 when worn. In one embodiment, layer 308 is the same material laminate as layer 306, but it is shown "gathering" or "puckering" in response to stretch layer 310 over layer 308.

Laminate 308 differs from laminate 306 at least in that it is loosely fitting to body 302. Layer 310 serves to pull rainwear 300 close to body 302, as noted.

Figure 5B:
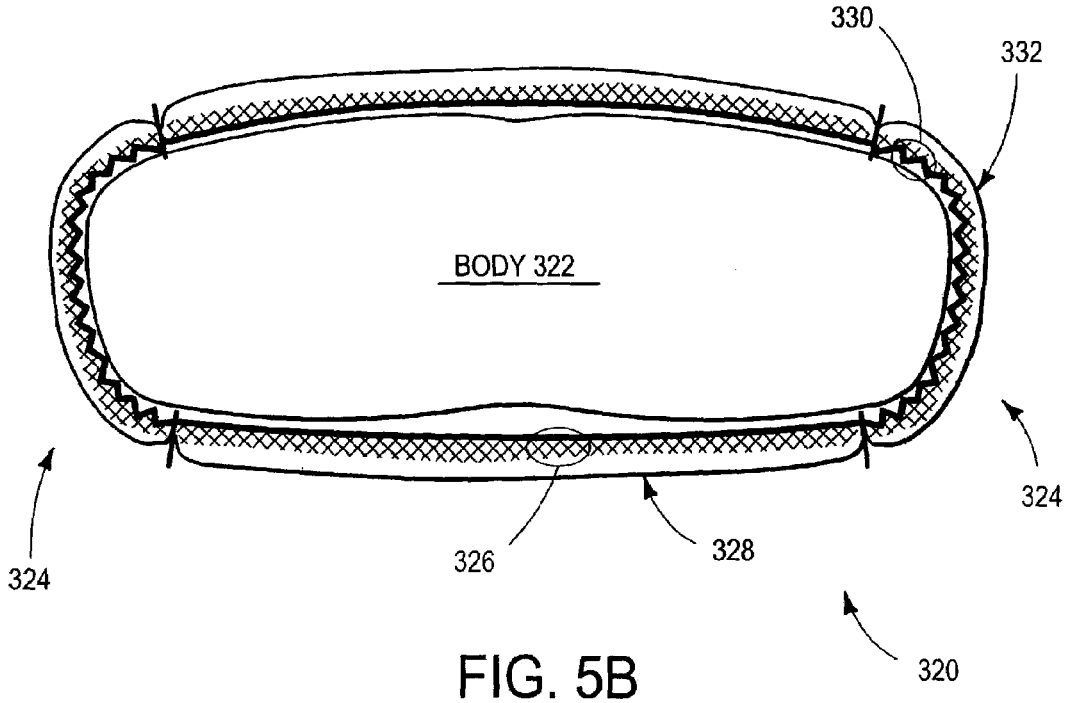
FIG. 5B shows one body form-fitting rainwear construction.

FIG. 5B shows another rainwear 320 about a body 322. Rainwear 320 has two side panels 324 that stretch about body 322 in creating a snug fit to body 322. Except for panels 324, rainwear 320 is made from a two-layer laminate 326, with little or no stretching capability; laminate 326 may include layers 12 and 14, FIG. 1, with layer 12 close to body 322. An outer layer 328 covers laminate 326; layer 328 is either a stretch knit or a stretch woven layer, which may or may not have stretch properties. Panels 324, on the other hand, are made from either a two-layer or three-layer laminate 330 and an outer stretch knit 332. The inner-most two layers of laminate 330 are for example layers 12, 14, FIG. 1, again with layer 12 adjacent body 322. If a third layer exists in laminate 330, it is for example outer layer 16. Stretch knit 332 is a woven material that pulls the entire rainwear 320 to body 322 when worn.

Laminate 330 differs from laminate 326 at least in that it is loosely fitting to body 322. Layer 332 serves to pull rainwear 320 close to body 322, as noted.

Figure 6:
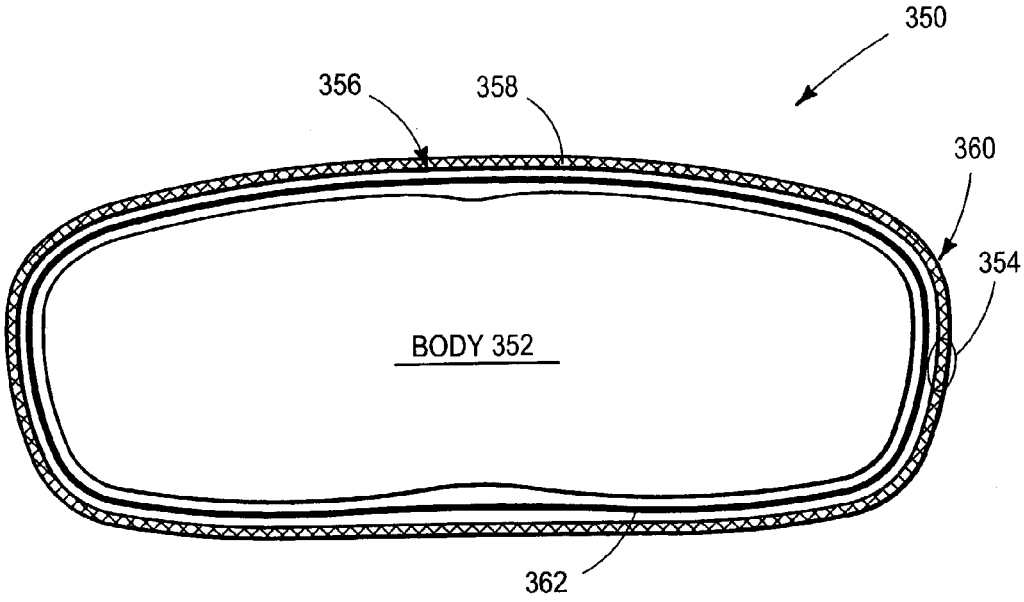
FIG. 6 shows one body form-fitting rainwear construction.

FIG. 6 shows one rainwear 350 about a body 352. Rainwear 350 includes a three-layer laminate 354. Laminate 354 may be formed as an inner knit layer 356, with little or no stretching capability, an inner waterproof, breathable layer 358, and an outer knit 360, also with little or no stretching capability. Layer 358 is for example layer 14 of FIG. 1. Laminate 354 conforms closely to body 352. If laminate 354 has some stretching capability, then it may conform tightly (e.g., body form-fitting).

Inner knit layer 356 may have a smooth sliding texture such as a tricot knit; or it may be a bi-component knit with some texture. Layer 360 may also be a bi-component knit.

Optionally, rainwear 350 is configured within an inner underwear layer 362. Layer 362 couples with layer 356 through techniques such as described in FIG. 1, and is for example a bi-component knit with or without wicking capability.

Figure 7:
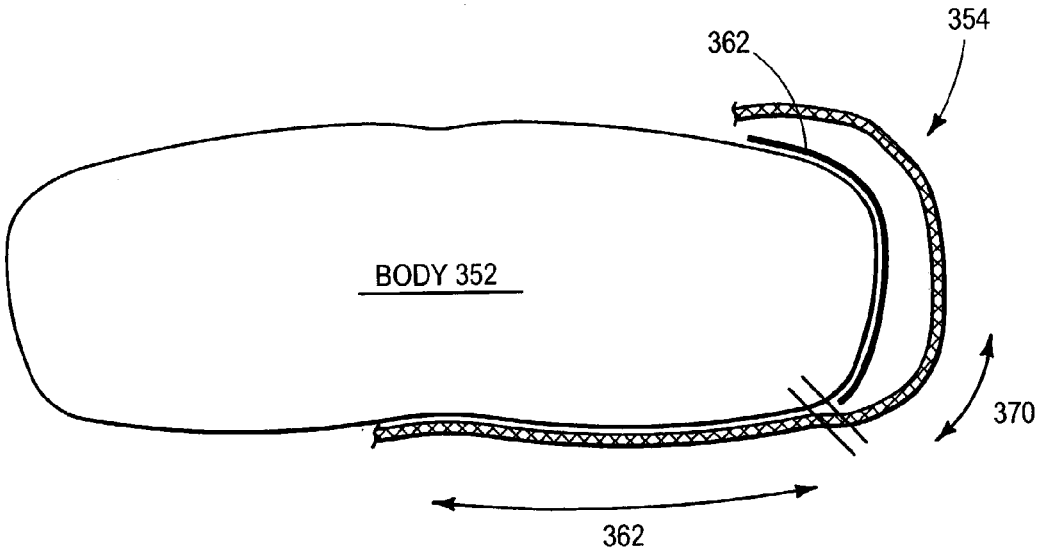
FIG. 7 shows the rainwear of FIG. 6 in snug or loosely fitting configurations.

FIG. 7 illustrates how laminate 354 may fit snugly or loosely about body 352. With underwear layer 362, laminate 354 may fit loosely to body 352, as illustrated by region 370 of FIG. 7. Without underwear layer 362, laminate 354 may fit snugly to body 352, as illustrated by region 372 of FIG. 7. Laminate 354 is not shown completely around body 352 for purposes of illustration, to offset the two the loose or snug fitting options 370, 372, respectively, of laminate 354.

Figure 8:
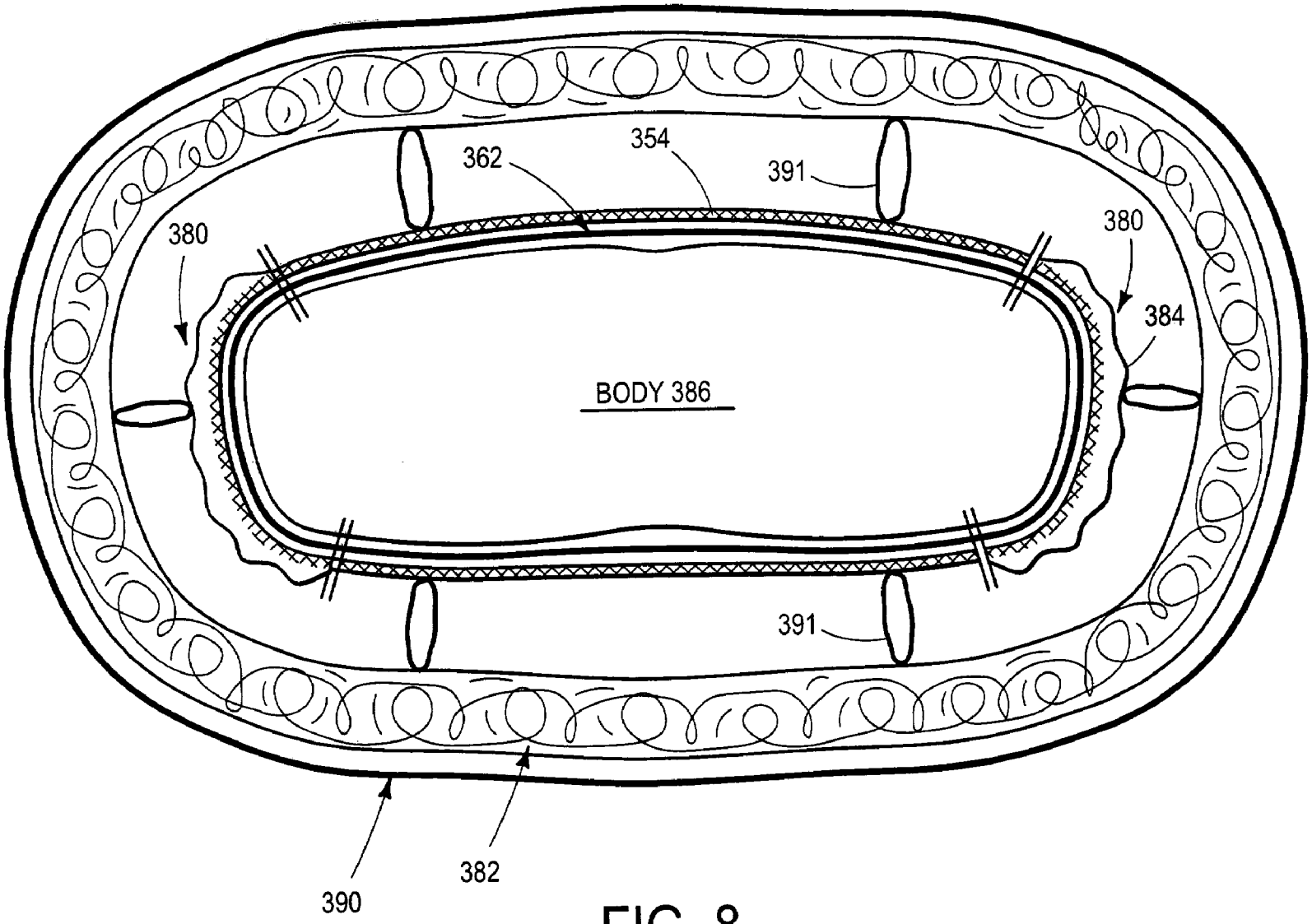
FIG. 8 shows one body form-fitting rainwear construction.

In one embodiment, laminate 354 is constructed with a side panel 380 and, optionally, with an outer insulation layer 382, as shown in FIG. 8. Laminate 354 and panel 380 together form body-form fitting rainwear about body 386. Side panel 380 may be made of layers of laminate 354 and an outer stretch knit 384, to pull the rainwear to the body 386. Insulation layer 382 loosely couples (e.g., with threading 391) to laminate 354 and panel 380, and may for example be sweater, fleece, and/or down insulating material of one or more layers. A water repellant layer 390 (or waterproof woven shell 390) may further cover insulation layer 382. Accordingly, laminate 354, panel 380 and insulation layer 382 (and/or layer 390) form a warm, comfortable clothing with body form-fitting rainwear properties described herein.

Figure 9:
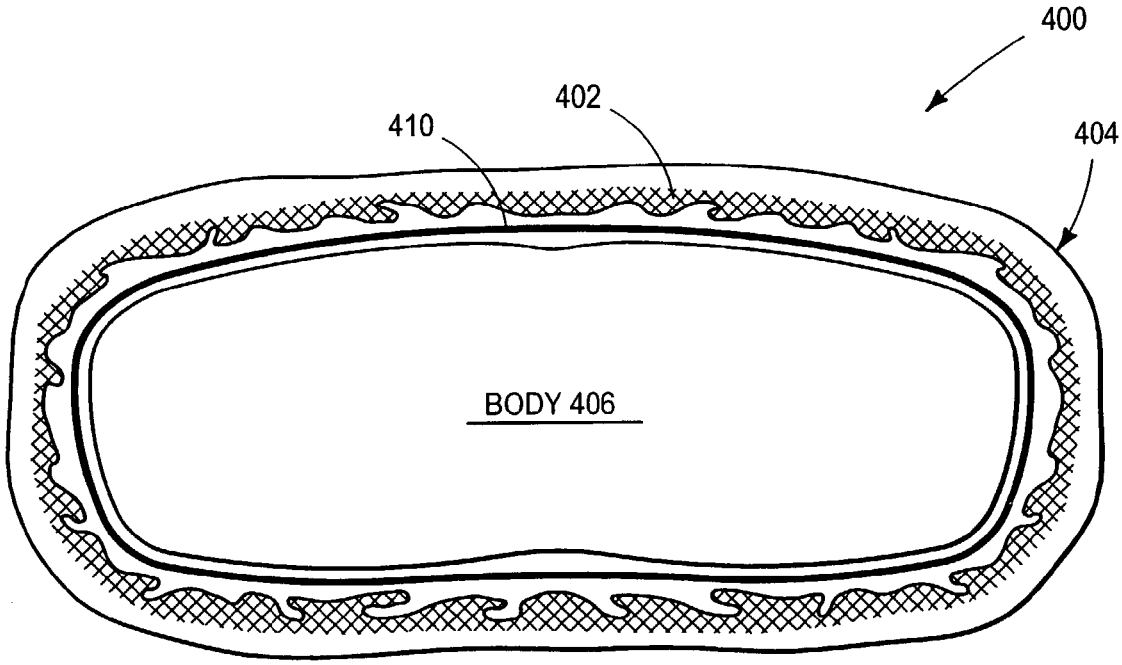
FIG. 9 shows one body form-fitting rainwear construction.

FIG. 9 shows one body form fitting rainwear 400 that includes a two-layer laminate 402 and an outer stretch knit or woven layer 404 to conform laminate 402 to body 406. Laminate 402 may for example be layers 12, 14 of FIG. 1, with layer 12 closest to body 406. Laminate 402 has little or no stretching capability (and, by itself would fit loosely over body 406) so that layer 404 forces laminate 402 against body 406 as body form-fitted rainwear. Optionally, rainwear 400 may include an underwear layer 410, which may be, for example, a bi-component knit with or without wicking capability. Rainwear 400 has advantages in that it provides a snug-fit to body 406 but is less expensive to manufacture by using inexpensive layer 404 separate from laminate 402.

Since certain changes may be made in the above methods and systems without departing from the scope hereof, it is intended that all matter contained in the above description or shown in the accompanying drawings be interpreted as illustrative and not in a limiting sense. It is also to be understood that the following claims are to cover all generic and specific features described herein, and all statements of the scope which, as a matter of language, might be said to fall there between.

What is claimed is:

1. Non-terminated, multi-aperture body form-fitting rainwear, comprising:

a first waterproof moisture vapor permeable hydrophobic layer, the first waterproof layer being oleophobic and air permeable, wherein the air permeability provides a majority of moisture vapor penetrating the first waterproof layer as transported by gaseous diffusion and convection, the first waterproof layer coupled to a first fabric layer, the first fabric layer facing the body and coupled to a first side of the first waterproof moisture vapor permeable hydrophobic layer, the first waterproof moisture vapor permeable hydrophobic layer and first fabric layer being formable about a human body and being constructed and arranged with multiple apertures to accommodate, without termination, two or more human appendages, and further comprising one or more waterproof seams for sealing joined edges of the first waterproof moisture vapor permeable hydrophobic layer and first fabric layer.

2. Rainwear of claim 1, the waterproof hydrophobic layer absorbing less than 10% in water weight when fully saturated by water, the waterproof hydrophobic layer resisting water penetration to at least 10 psi, the waterproof hydrophobic layer and the first fabric layer having, in combination, a moisture vapor transmission rate (MVTR) greater than or equal to 5000 grams per square meter per day.

3. Rainwear of claim 2, the waterproof hydrophobic layer and the first fabric layer having, in combination, a MVTR greater than or equal to 10,000 grams per square meter per day.

4. Rainwear of claim 2, the waterproof hydrophobic layer and the first fabric layer having, in combination, a MVTR greater than or equal to 20,000 grams per square meter per day.

5. Rainwear of claim 2, the waterproof hydrophobic layer and the first fabric layer having, in combination, a MVTR greater than or equal to 30,000 grams per square meter per day.

6. Rainwear of claim 1, wherein the first waterproof hydrophobic layer comprises expanded polytetafluoroethylene with a hydrophobic oleophobic treatment.

7. Rainwear of claim 1, the waterproof hydrophobic layer absorbing less than 5% in water weight when fully saturated by water.

8. Rainwear of claim 1, the waterproof hydrophobic layer absorbing less than 2% in water weight when fully saturated by water.

9. Rainwear of claim 1, wherein the first fabric layer comprises one of a knitted fabric, a woven fabric, and a non-woven fabric.

10. Rainwear of claim 1, wherein the first waterproof hydrophobic layer and the first fabric layer are constructed and arranged to substantially form fit to the body, on average, to within about 2.54 cm.

11. Rainwear of claim 1, wherein the first waterproof hydrophobic layer and the first fabric layer are constructed and arranged substantially skin tight to the body.

12. Rainwear of claim 1, wherein the first fabric layer comprises a bicomponent material.

13. Rainwear of claim 12, wherein the bicomponent material comprises hydrophobic and hydrophilic fibers.

14. Rainwear of claim 1, wherein the first fabric layer comprises plaited knit.

15. Rainwear of claim 1, wherein the first waterproof hydrophobic layer and the first fabric layer have a combined cross-sectional thickness of less than about 3 mm.

16. Rainwear of claim 1, further comprising a plurality of adhesive dots for coupling the first waterproof hydrophobic layer to the first fabric layer.

17. Rainwear of claim 16, the adhesive dots comprising one of a hydrophobic or hydrophilic material.

18. Rainwear of claim 1, further comprising a web adhesive for coupling the first waterproof hydrophobic layer to the first fabric layer.

19. Rainwear of claim 1, further comprising an outer fabric layer coupled to a second side of the waterproof hydrophobic layer for protecting the first waterproof hydrophobic layer and the first fabric layer, without interference with the apertures, the outer fabric layer being selected from the group consisting of one of woven, knit, and non-woven material.

20. Rainwear of claim 19, further comprising a plurality of adhesive dots for coupling the outer layer to the first waterproof hydrophobic layer.

21. Rainwear of claim 19, the outer layer being sewn to a perimeter of the first waterproof hydrophobic layer.

22. Rainwear of claim 1, the outer layer comprising one of fabric and elastic stretch material, the material being one of sewn and bonded to one or both of a surface area or perimeter of the first waterproof moisture vapor permeable hydrophobic layer.

23. Rainwear of claim 19, wherein the outer fabric layer and the first waterproof hydrophobic layer form an airspace therebetween to within about 1/100 inch and ½ inch.

24. Rainwear of claim 19, wherein the first waterproof hydrophobic layer, the first fabric layer, and the outer fabric layer form underwear.

25. Rainwear of claim 19, wherein the outer fabric comprises one of nylon, polyester, acrylic, polypropylene, polyolefin and synthetic fiber material.

26. Rainwear of claim 1, wherein the first waterproof moisture vapor permeable hydrophobic layer comprises polyurethane.

27. Rainwear of claim 1, wherein the first waterproof moisture vapor permeable hydrophobic layer comprises ePTFE.

28. Rainwear of claim 1, wherein the first waterproof moisture vapor permeable hydrophobic layer comprises one of polyolefin and polyester.

29. Rainwear of claim 1, further comprising a second waterproof moisture vapor permeable hydrophobic layer having a first side coupled to a second side of the first waterproof hydrophobic layer, and a second fabric layer coupled to a second side of the second waterproof moisture vapor permeable hydrophobic layer, the first and second waterproof moisture vapor permeable hydrophobic layers and the first and second fabric layers being formable about a human body and being constructed and arranged with the multiple apertures to accommodate, without termination, the two or more human appendages.

30. Rainwear of claim 29, the second waterproof moisture vapor permeable hydrophobic layer absorbing less than 10% in water weight when fully saturated by water, the second waterproof hydrophobic layer resisting water penetration to at least 10 psi, the first and second waterproof hydrophobic layers and the first and second fabric layers having, in combination, a moisture vapor transmission rate (MVTR) greater than or equal to 3500 grams per square meter per day, the first and second waterproof hydrophobic layers and the first and second fabric layers being formable about at least part of a human body.

31. Rainwear of claim 1, the seams comprising one or more of seam tape, ultrasonic welding, radio-frequency welding, and adhesive bonding.

32. Non-terminated, multi-aperture body form-fitting rainwear, comprising:

a first waterproof moisture vapor permeable hydrophobic layer, the first waterproof layer being oleophobic and air permeable, wherein the air permeability provides a majority of moisture vapor penetrating the first waterproof layer as transported by gaseous diffusion and convection, the first waterproof layer coupled to a first fabric layer, the first fabric layer facing the body and coupled to a first side of the first waterproof moisture vapor permeable hydrophobic layer, a second waterproof moisture vapor permeable hydrophobic layer having a first side coupled to a second side of the first waterproof hydrophobic layer, a second fabric layer coupled to a second side of the second waterproof moisture vapor permeable hydrophobic layer, the first and second waterproof moisture vapor permeable hydrophobic layers and the first and second fabric layers being formable about a human body and being constructed and arranged with the multiple apertures to accommodate, without termination, the two or more human appendages, a first seam joining edges of the first waterproof moisture vapor permeable hydrophobic layer and the first fabric layer, a second seam joining edges of the second waterproof seam with the second fabric layer, the seams being offset from one another to inhibit moisture passage through the rainwear at the seams.

33. Rainwear of claim 32, further comprising stitching for coupling the first and second waterproof hydrophobic layers together at a perimeter of one or both of the first and second waterproof hydrophobic layers.

34. Rainwear of claim 32, further comprising a plurality of adhesive dots for coupling the second waterproof hydrophobic layer to the second fabric layer.

35. Rainwear of claim 32, the second waterproof hydrophobic layer being air permeable.

36. Rainwear of claim 32, the first hydrophobic waterproof layer and first fabric layer being coupled to the second hydrophobic waterproof layer and second fabric by layers by perimeter sewing.

37. Rainwear of claim 36, the first waterproof hydrophobic layer being air permeable.

38. Rainwear of claim 37, wherein the first waterproof hydrophobic layer comprises one of polyurehtane, polyester, and polyolefin material.

39. Body form-fitting underwear, comprising:

a first waterproof moisture vapor permeable hydrophobic layer, the first waterproof layer being oleophobic and air permeable, wherein the air permeability provides a majority of moisture vapor penetrating the first waterproof layer as transported gaseous diffusion and convection, the first waterproof layer coupled to a first fabric layer, the first fabric layer facing the body and coupled to a first side of the first waterproof moisture vapor permeable hydrophobic layer, the first waterproof moisture vapor permeable hydrophobic layer and first fabric layer having a waterproof barrier at a perimeter of the fabrics to prevent moisture from entering at the perimeter.

40. Underwear of claim 39, comprising seam tape.

41. Underwear of claim 40, the barrier comprising a weld.

42. Underwear of claim 41, the weld being formed by one of heat flow adhesive, melt polymer applied with radio-frequency energy, and ultrasonic welding.

43. A body form-fitting hood or hat, comprising:

a first waterproof moisture vapor permeable hydrophobic layer, the first waterproof layer being oleophobic and air permeable, wherein the air permeability provides a majority of moisture vapor penetrating the first waterproof layer as transported by gaseous diffusion and convection. the first waterproof layer coupled to a first fabric layer, the first fabric layer facing the body and coupled to a first side of the first waterproof moisture vapor permeable hydrophobic layer, the first waterproof moisture vapor permeable hydrophobic layer and first fabric layer having a waterproof barrier at a perimeter of the fabrics to prevent moisture from entering at the perimeter.

44. Body form-fitting rainwear, comprising:

a first waterproof moisture vapor permeable hydrophobic layer, the first waterproof layer being oleophobic and air permeable, wherein the air permeability provides a majority of moisture vapor penetrating the first waterproof layer as transported by gaseous diffusion and convection, the first waterproof layer coupled to a first fabric layer, the first fabric layer facing the body and coupled to a first side of the first waterproof moisture vapor permeable hydrophobic layer, the first waterproof moisture vapor permeable hydrophobic layer and first fabric layer being formable about a human body, and a second waterproof moisture vapor permeable hydrophobic layer coupled to a second fabric layer, the second fabric layer forming an outer-most layer away from the body, one or more first zippers segregating the first waterproof moisture vapor permeable hydrophobic layer and the first fabric layer, one or more second zippers segregating the second waterproof moisture vapor permeable hydrophobic layer and the second fabric layer, the first and second zippers being offset from one another to inhibit moisture penetration therethrough.

45. Non-terminated, multi-aperture body form-fitting rainwear, comprising:

a first waterproof moisture vapor permeable hydrophilic layer, the first waterproof layer being oleophobic and air permeable, wherein the air permeability provides a majority of moisture vapor penetrating the first waterproof layer as transported by gaseous diffusion and convection, the first waterproof layer coupled to a first fabric layer, the first fabric layer facing the body and coupled to a first side of the first waterproof moisture vapor permeable hydrophilic layer, the first waterproof moisture vapor permeable hydrophilic layer and first fabric layer being formable about a human body and being constructed and arranged with multiple apertures to accommodate, without termination, two or more human appendages, an outer fabric layer coupled to a second side of the waterproof hydrophilic layer for protecting the first waterproof hydrophilic layer and the first fabric layer, without interference with the apertures, the outer fabric layer being selected from the group consisting of one of woven, knit, and non-woven material, and further comprising one or more waterproof seams for sealing joined edges of the first waterproof moisture vapor permeable hydrophilic layer and first fabric layer.

* * * * *

UNITED STATES PATENT AND TRADEMARK OFFICE

CERTIFICATE OF CORRECTION

PATENT NO. : 7,162,746 B2
APPLICATION NO. : 10/316343
DATED : January 16, 2007
INVENTOR(S) : Eric M. Reynolds It is certified that error appears in the above-identified patent and that said Letters Patent is hereby corrected as shown below:

Column 10, line 28, claim 37, the word “polyurehtane” should read --polyurethane--;

Signed and Sealed this

Sixteenth Day of October, 2007

JON W. DUDAS
*Director of the United States Patent and Trademark Office*